US010364593B2

(12) United States Patent
Alexander et al.

(10) Patent No.: US 10,364,593 B2
(45) Date of Patent: Jul. 30, 2019

(54) CLOSURE RELEASE DEVICE

(71) Applicants: GM Global Technology Operations LLC, Detroit, MI (US); DYNALLOY, INC., Tustin, CA (US)

(72) Inventors: Paul W. Alexander, Ypsilanti, MI (US); Richard J. Skurkis, Lake Orion, MI (US); James Holbrook Brown, Temecula, CA (US); Aragorn Zolno, Whittier, CA (US); Tyler P. Ownby, Huntington Beach, CA (US); Paulo M. Mendonca, Sao Caetano do Sul (BR)

(73) Assignees: GM GLOBAL TECHNOLOGY OPERATIONS LLC, Detroit, MI (US); DYNALLOY, INC., Tustin, CA (US)

( * ) Notice: Subject to any disclaimer, the term of this patent is extended or adjusted under 35 U.S.C. 154(b) by 1088 days.

(21) Appl. No.: 14/711,180

(22) Filed: May 13, 2015

(65) Prior Publication Data

US 2015/0330118 A1 Nov. 19, 2015

Related U.S. Application Data

(60) Provisional application No. 61/992,575, filed on May 13, 2014.

(51) Int. Cl.
*E05B 47/00* (2006.01)
*E05B 85/10* (2014.01)
(Continued)

(52) U.S. Cl.
CPC ..... *E05B 47/0009* (2013.01); *E05B 81/04* (2013.01); *E05B 81/16* (2013.01);
(Continued)

(58) Field of Classification Search
CPC ..... E05B 13/005; E05B 15/04; E05B 15/16; E05B 47/0009; E05B 81/04; E05B 81/16; E05B 81/74; E05B 85/10; E05B 85/18; E05B 85/20; E05B 51/005; Y10S 292/23; Y10S 292/27; Y10S 292/29; Y10S 292/61; Y10S 292/66; Y10T 292/0962; Y10T 292/1014; Y10T 292/1015; Y10T 292/108;
(Continued)

(56) References Cited

U.S. PATENT DOCUMENTS 5,987,943 A 11/1999 Verga et al.
6,523,869 B1 2/2003 Jensen et al.
(Continued)

*Primary Examiner* — Christine M Mills
(74) *Attorney, Agent, or Firm* — Harness, Dickey & Pierce, P.L.C.

(57) ABSTRACT

A closure release device includes a housing fixedly attached to a closure and an actuating lever rotatably disposed on an axis of rotation on the housing. A crank lever is rotatably disposed on the axis of rotation. A coupling member is to selectively couple the actuating lever to the crank lever for rotation together. A shape memory alloy (SMA) actuator is to selectively cause the coupling member to selectively couple the actuating lever to the crank lever. The SMA actuator is electrically actuated. The crank lever is to connect to a latch to selectively release or engage the latch in response to a coupling state of the actuating lever with the crank lever and an actuation state of the actuating lever.

16 Claims, 13 Drawing Sheets

(51) Int. Cl.

| | |
|---|---|
| ***E05B 85/20*** | (2014.01) |
| ***E05B 81/04*** | (2014.01) |
| ***E05B 81/16*** | (2014.01) |
| ***E05B 85/18*** | (2014.01) |
| ***E05B 81/74*** | (2014.01) |

(52) U.S. Cl.
CPC ..... *E05B 81/74* (2013.01); *E05B 85/10* (2013.01); *E05B 85/18* (2013.01); *E05B 85/20* (2013.01); *Y10T 292/108* (2015.04)

(58) Field of Classification Search
CPC ..... Y10T 292/0963; Y10T 292/0967; Y10T 292/102; Y10T 292/1082; Y10T 292/1047
USPC ..... 292/157, 138, 139, 200, 158, 161, 143, 292/DIG. 23, 201, 216, DIG. 27, DIG. 29, 292/DIG. 61, DIG. 66
See application file for complete search history.

(56) References Cited

U.S. PATENT DOCUMENTS

| | | | | |
|---|---|---|---|---|
| 7,364,211 | B2 * | 4/2008 | Niskanen | E05B 47/0009 292/201 |
| 7,850,219 | B2 | 12/2010 | Townson et al. | |
| 8,096,592 | B2 * | 1/2012 | Mrkovic | E05B 47/0009 292/201 |
| 8,740,279 | B1 * | 6/2014 | McGoff | E05B 83/20 296/51 |
| 2013/0305705 | A1 * | 11/2013 | Ac | E05B 47/0009 60/527 |

* cited by examiner

CLOSURE RELEASE DEVICE

CROSS REFERENCE TO RELATED APPLICATIONS

This application claims the benefit of U.S. Provisional Patent Application Ser. No. 61/992,575, filed May 13, 2014, which is incorporated by reference herein in its entirety.

BACKGROUND

Some motor vehicles, such as pickup trucks, are equipped with a pivotable end gate that closes off the end of a rear storage area. The end gate (also known as a "tailgate") is a door assembly extending transversely across the width of a rear portion of the vehicle. The end gate is normally hinged to the vehicle body at opposing side edges, near the bottom of the door assembly. The end gate is often mounted to two rear pillars between body side-panels that cooperatively form a vehicle storage area, such as the bed or box of a pickup truck or the rear cargo compartment of a sport utility vehicle (SUV). The end gate may be operable to be unlatched, and swung from a vertical, closed position to a horizontal, open position that is approximately coplanar with an interior floor surface of the vehicle storage area.

SUMMARY

A closure release device includes a housing fixedly attached to a closure and an actuating lever rotatably disposed on an axis of rotation on the housing. A crank lever is rotatably disposed on the axis of rotation. A coupling member is to selectively couple the actuating lever to the crank lever for rotation together. A shape memory alloy (SMA) actuator is to selectively cause the coupling member to selectively couple the actuating lever to the crank lever. The SMA actuator is electrically actuated. The crank lever is to connect to a latch to selectively release or engage the latch in response to a coupling state of the actuating lever with the crank lever and an actuation state of the actuating lever.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

A vehicle includes a vehicle body that is represented herein by a bed portion (also referred to in the art as "cargo bed" or "pickup box") that is rearward of a cab portion. The bed portion has a bed floor with side-body structures, such as two sidewalls, respectively positioned on opposing sides thereof.

Figure 1:
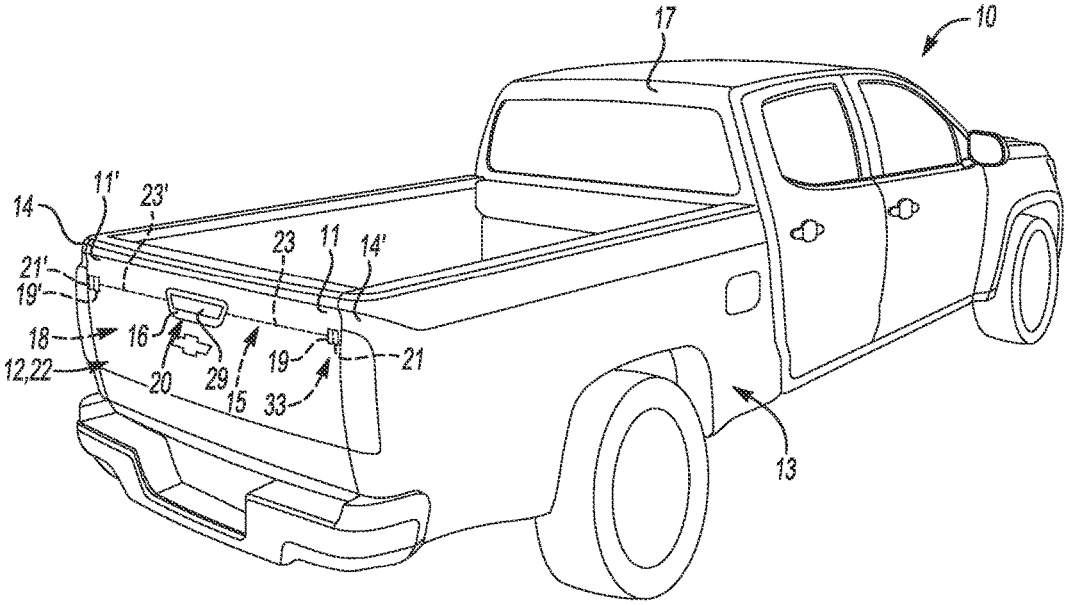
FIG. 1 is a rear perspective view of a vehicle having an end gate.
Figure 2:
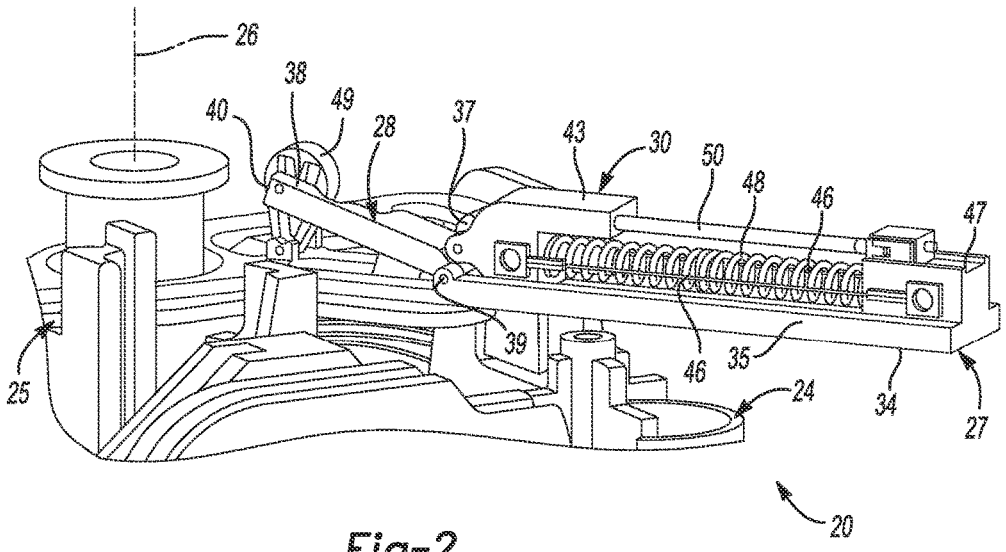
FIG. 2 is a cutaway perspective view of an example of a closure release device, showing an example of a Shape Memory Alloy (SMA) actuator disposed therein according to the present disclosure.
Figure 3:
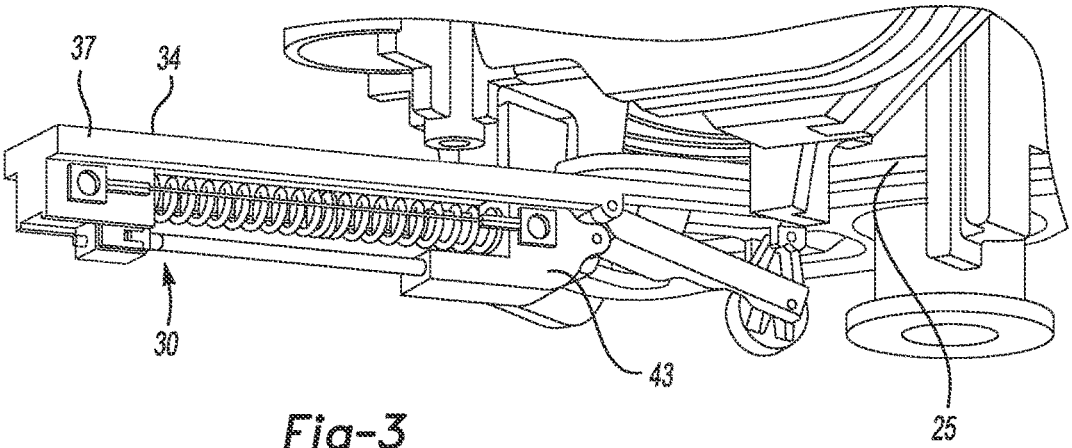
FIG. 3 is a top view of the example of the SMA actuator disposed in the example of the closure release device of FIG. 2.
Figure 4:
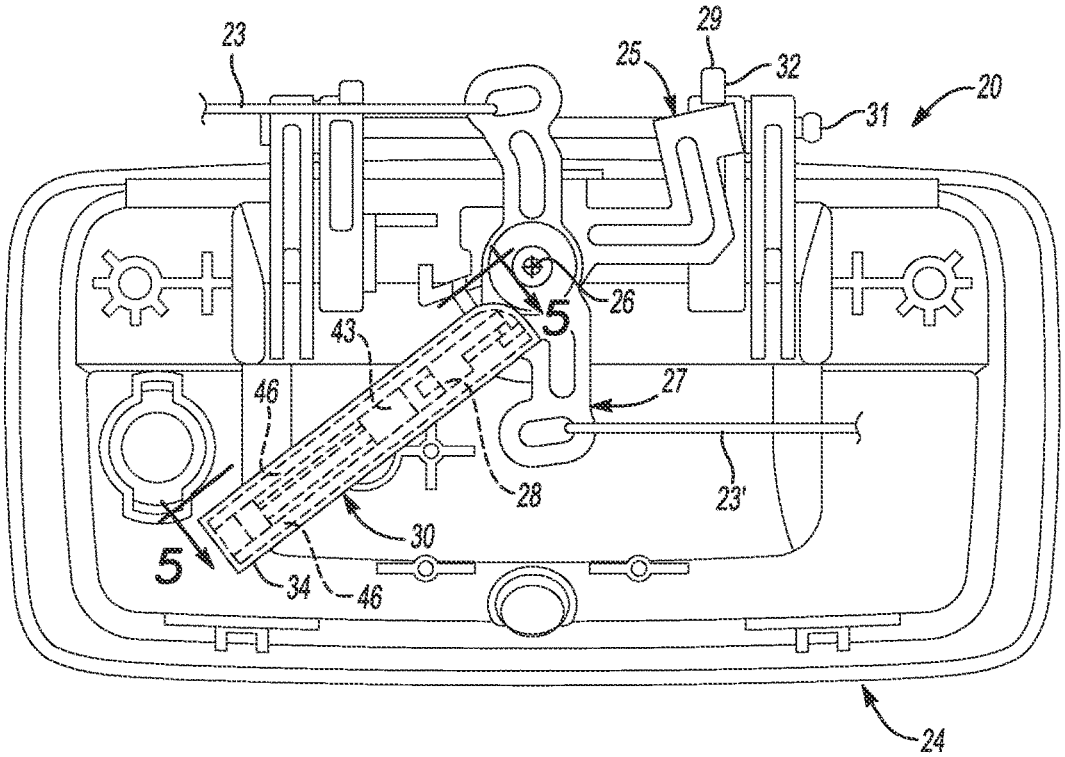
FIG. 4 is a front view of the example of the SMA actuator disposed in the example of the closure release device of FIG. 2.

Referring now to FIG. 1, there is shown a rear perspective view of a vehicle 10. An end gate assembly 12 is mounted at laterally opposing sides 11 thereof to the sidewalls 14, 14' of the vehicle body 13. The end gate assembly 12 may be a drop-down, trunnion type end gate, that is pivotable between a first, generally vertical, closed position, in which the end gate assembly is generally perpendicular to the floor portion; and a second, generally horizontal, open position, in which the end gate assembly is generally coplanar to the floor portion. A latch mechanism 15, which may incorporate a locking device 16, is employed to selectively secure the end gate assembly 12 in the closed position, thereby forming a compartment between the end gate assembly 12, first and second sidewalls 14, 14', and the cab portion 17. A rearward facing opening 18 is created between the sidewalls 14, 14' when the end gate assembly 12 is displaced from its closed position, and rotated into the open position to allow for ease of use in loading and unloading cargo.

The end gate assembly 12 is an example of a closure 22. Another name for an end gate of a vehicle is "tailgate." Although the examples described in detail in the present disclosure are directed to an end gate assembly 12, it is to be understood that the closure release device 20 of the present disclosure may be applied to any closure 22, including, for example, a lift gate that pivots near the top, swing gate that pivots on one side, or a vehicle side door. The closure 22 may be a vehicle closure, however, the SMA actuator and SMA actuator modules of the present disclosure may be applied to any closure 22, including residential doors and windows, automated teller machine closures, locker closures, cabinet closures, etc.

The latch mechanism 15 of the present disclosure may include latch bolts 19, 19' that selectably protrude from the sides 11, 11' of the end gate assembly 12 to be received by strikers 21, 21' mounted to the sidewalls 14, 14'. In another example, the strikers 21, 21' may protrude from the sidewalls 14, 14' and the latch bolts 19, 19' may rotate to engage the strikers 21, 21'. A closure release device 20 is part of the latch mechanism 15 that actuates the latch bolts 19, 19' to cause the latch bolts 19, 19' to disengage from the strikers 21, 21' and allow the closure 22 to open. In an example, the closure release device 20 may actuate the latch bolts 19, 19' via latch rods 23, 23', or latch cables (not shown).

Examples of the present disclosure include Shape Memory Alloy (SMA) actuators disposed in a closure release device. Shape memory alloys generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. Generally, in the low temperature, or Martensite phase, shape memory alloys can be pseudo-plastically deformed and upon exposure to some higher temperature will transform to an Austenite phase, or parent phase, and return, if not under stress, to their shape prior to the deformation.

Shape memory alloys exist in several different temperature-dependent phases. The most commonly utilized of these phases are Martensite and Austenite phases. In the following discussion, the Martensite phase generally refers to the more deformable, lower temperature phase; whereas the Austenite phase generally refers to the more rigid, higher temperature phase. When the shape memory alloy is in the Martensite phase and is heated, it begins to change into the Austenite phase. The temperature at which this phenomenon starts is often referred to as Austenite start temperature ($A_s$). The temperature at which this phenomenon is complete is called the Austenite finish temperature ($A_f$).

When the SMA is in the Austenite phase and is cooled, it begins to change into the Martensite phase, and the temperature at which this phenomenon starts is referred to as the Martensite start temperature ($M_s$). The temperature at which Austenite finishes transforming to Martensite is called the Martensite finish temperature ($M_f$). Thus, a suitable activation signal for use with shape memory alloys is an electric current having an amperage sufficient to cause transformations between the Martensite and Austenite phases.

The temperature at which the SMA remembers its high temperature form when heated can be adjusted by slight changes in the composition of the alloy, through heat treatment, and by exposing the alloy to stress. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

FIGS. 2-8 depict an example of an SMA actuator 30 disposed in a closure release device 20 according to the present disclosure. The closure release device 20 includes a housing 24 fixedly attached to the closure 22 (see FIG. 1). The closure release device 20 includes a handle 29 (see FIG. 1) rotatably attached to the housing 24. The handle 29 is to be grasped and pulled (e.g. by a person) to unlatch the closure 22 and allow the closure 22 to be opened. An actuating lever 25 is rotatably disposed on an axis of rotation 26 on the housing 24. The actuating lever 25 is spring-biased to a rest position. The rest position of the actuating lever 25 corresponds to a released position of the handle 29. The released position of the handle 29 is opposite to a pulled position of the handle 29. A crank lever 27 is rotatably disposed on the axis of rotation 26. A coupling member 28 is to selectively couple the actuating lever 25 to the crank lever 27 for rotation together.

When the handle 29 (see FIG. 1) is pulled, the handle 29 rotates about the pivot pin 31 (see FIG. 4), thereby causing the handle lever arm 32 to rotate against the actuating lever 25. When the coupling member 28 is in the unlocked position shown in FIG. 5, the coupling member 28 engages the crank lever 27 and causes the crank lever 27 to rotate with the actuating lever 25. As the actuating lever 25 is rotated from the retracted state to the fully actuated state, the crank lever 27 rotates, and the latch rods 23, 23' are actuated, thereby causing the latch bolts 19, 19' to disengage from the strikers 21, 21' and allowing the closure 22 to open (see also FIG. 1). When the coupling member 28 is in the locked position shown in FIG. 6, the coupling member 28 withdraws from the crank lever 27 and allows the actuating lever 25 to rotate independently from the crank lever 27. Therefore, in the example depicted in FIGS. 2-8, when the coupling member 28 is in the locked position (shown in FIG. 6) and the handle 29 is pulled, the handle 29 will move and the actuating lever 25 will rotate, but the crank lever 27 will not rotate and the latch bolts 19, 19' will remain engaged with strikers 21, 21', thereby keeping the closure 22 closed.

Figure 5:
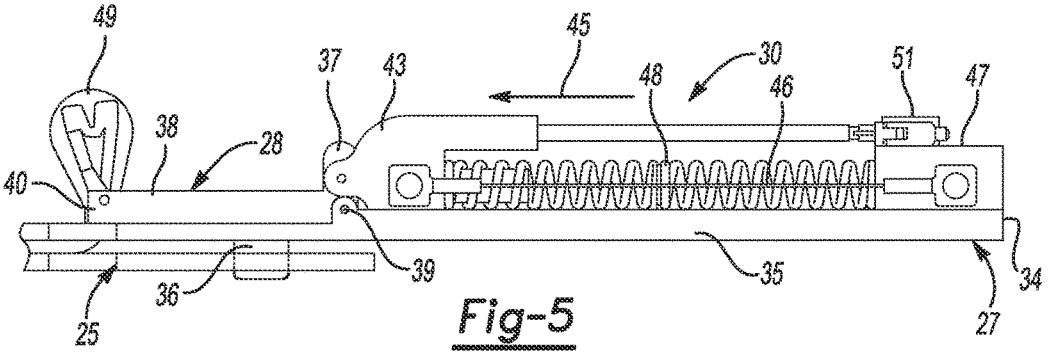
FIG. 5 is an auxiliary view in the direction shown in FIG. 4 depicting the SMA actuator of FIG. 4 in an unlocked state.
Figure 6:
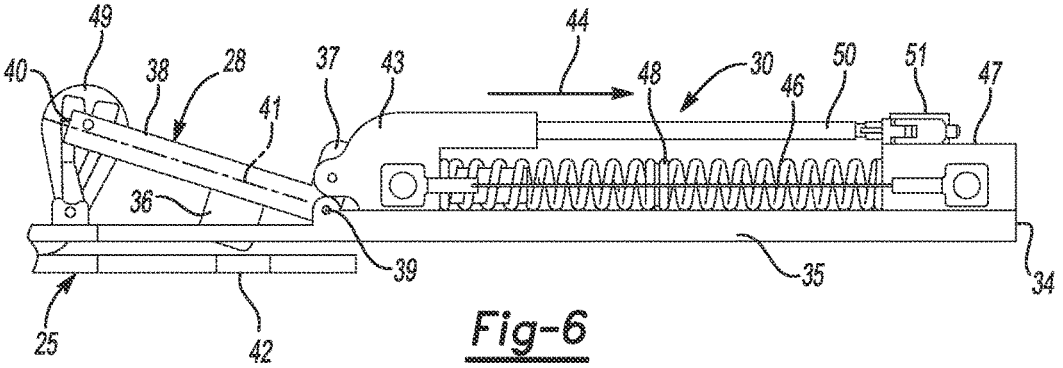
FIG. 6 is an auxiliary view in the same direction as FIG. 5, depicting the SMA actuator of FIG. 4 in a locked state.
Figure 7:
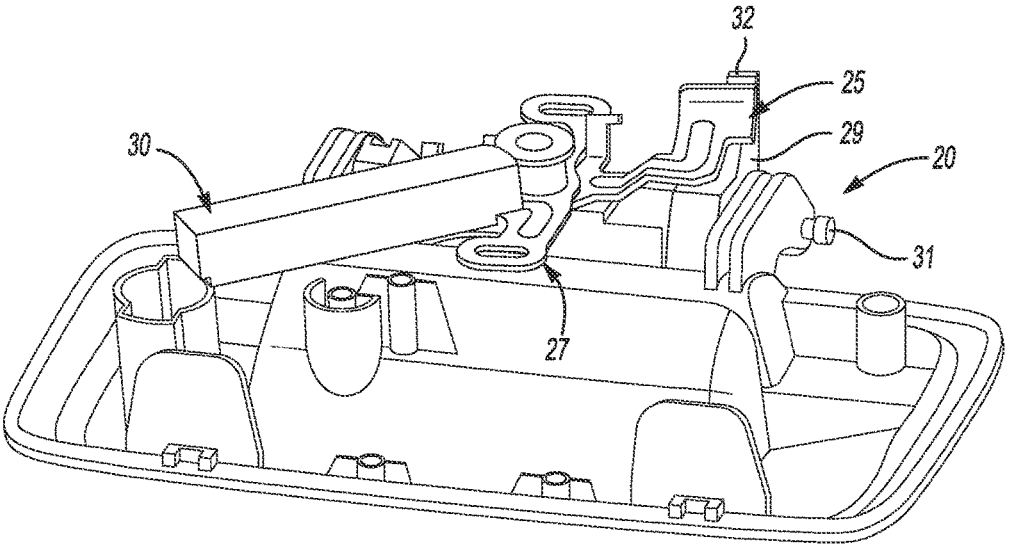
FIG. 7 is a bottom perspective view of the example of the closure release device depicted in FIG. 4.

In examples of the present disclosure, the SMA actuator 30 is to selectively cause the coupling member 28 to selectively couple the actuating lever 25 to the crank lever 27. The SMA actuator 30 is electrically actuated. The crank lever 27 is to connect to a latch 33 (for example, the latch bolt 19 and striker 21 via the latch rod 23 in FIG. 1) to selectively release or engage the latch 33 in response to a coupling state of the actuating lever 25 with the crank lever 27 and an actuation state of the actuating lever 25. In the example depicted in FIGS. 2-8, the coupling state of the actuating lever 25 with the crank lever 27 is either "coupled" or "uncoupled". The coupling state is "coupled" when the coupling member 28 is in the "unlocked" position, e.g., as depicted in FIG. 5. To clarify, the "unlocked" position does not imply that the actuating lever 25 is "uncoupled" from the crank lever 27. In this context, "unlocked" means that the closure 22 may be opened by pulling on the handle 29. Conversely, the coupling state is "uncoupled" when the coupling member 28 is in the "locked" position, e.g., as depicted in FIG. 6. In this context, "locked" means that the closure 22 does not open when the handle 29 is pulled because the actuating lever 25 is "uncoupled" from the crank lever 27.

The SMA actuator 30 depicted in FIGS. 2-8 is integrated into the crank lever 27. An SMA actuator arm 34 of the crank lever 27 is a substrate 35 for the SMA actuator 30. The coupling member 28 is pivotally connected to the substrate 35 at a hinge pin 39. The coupling member 28 has an input arm 37 and an indexing arm 38 opposite the input arm 37. The input arm 37 extends perpendicularly to the indexing arm 38 from the hinge pin 39. The hinge pin 39 is between the input arm 37 and the indexing arm 38. In the example depicted in FIGS. 2-8, the input arm 37 is shorter than the indexing arm 38, so an output displacement of the indexing arm 38 is amplified in response to the input displacement of the input arm 37. A pawl tooth 36 (see FIGS. 5 and 6) is defined on the indexing arm 38 between an indexing end 40 and the hinge pin 39. The pawl tooth 36 extends tangentially to a radial line 41 extending from the hinge pin 39 to an indexing end 40 of the indexing arm 38. In the "unlocked" position depicted in FIG. 5, the indexing arm 38 is parallel to the substrate 35 and the pawl tooth 36 protrudes through the substrate 35 to engage a complementary shaped coupling aperture 42 defined in the actuating lever 25. In the "unlocked" position, the input arm 37 extends normal to the substrate 35 from the hinge pin 39. In the "locked" position depicted in FIG. 6, the indexing arm 38 is oblique to the substrate 35 and the pawl tooth 36 is disengaged from the actuating lever 25.

The example of the SMA actuator 30 depicted in FIGS. 2-8 includes a shuttle 43 connected to the input arm 37. The shuttle 43 slides linearly along the substrate 35. As the shuttle 43 slides in a disengaging direction 44 away from the hinge pin 39, the input arm 37 is pulled to rotate the coupling member 28 toward the "locked" position depicted in FIG. 6. As the shuttle 43 slides in an engaging direction 45, opposite the disengaging direction 44, the input arm 37 is pushed to rotate the coupling member 28 toward the "unlocked" position depicted in FIG. 5. As depicted in FIGS. 2-8, 2 SMA wires 46 are connected to the shuttle 43 and anchored on a bulkhead 47 established on the substrate 35. Although 2 SMA wires 46 are shown in the example depicted in FIGS. 2-8, it is to be understood that examples may have any number of SMA wires 46, for example 1, 2, 3, 4 etc. The SMA wires 46 contract when activated, thereby urging the shuttle 43 and the coupling member 28 toward the "locked" position shown in FIG. 6. A return spring 48 is antagonistic to the SMA wires 46, urging the shuttle 43 and the coupling member 28 toward the "unlocked" position shown in FIG. 5. The SMA wires 46 are to overcome the return spring 48 when activated. When the SMA wires 46 are deactivated, the return spring 48 provides a restoring force to the shuttle 43 that stretches the SMA wires 46.

The example of the SMA actuator 30 depicted in FIGS. 2-8 further includes a push-push latch 49 connected to the indexing end 40 of the indexing arm 38. The push-push latch 49 holds the indexing arm 38 in the "locked" position shown in FIG. 6 after a first activation and first deactivation of the SMA wires 46. To clarify, the push-push latch 49 blocks the indexing arm 38, preventing the return spring 48 from causing the coupling member 28 to achieve the "unlocked" position shown in FIG. 5 until a second activation and second deactivation of the SMA wires 46 occur.

Figure 8:
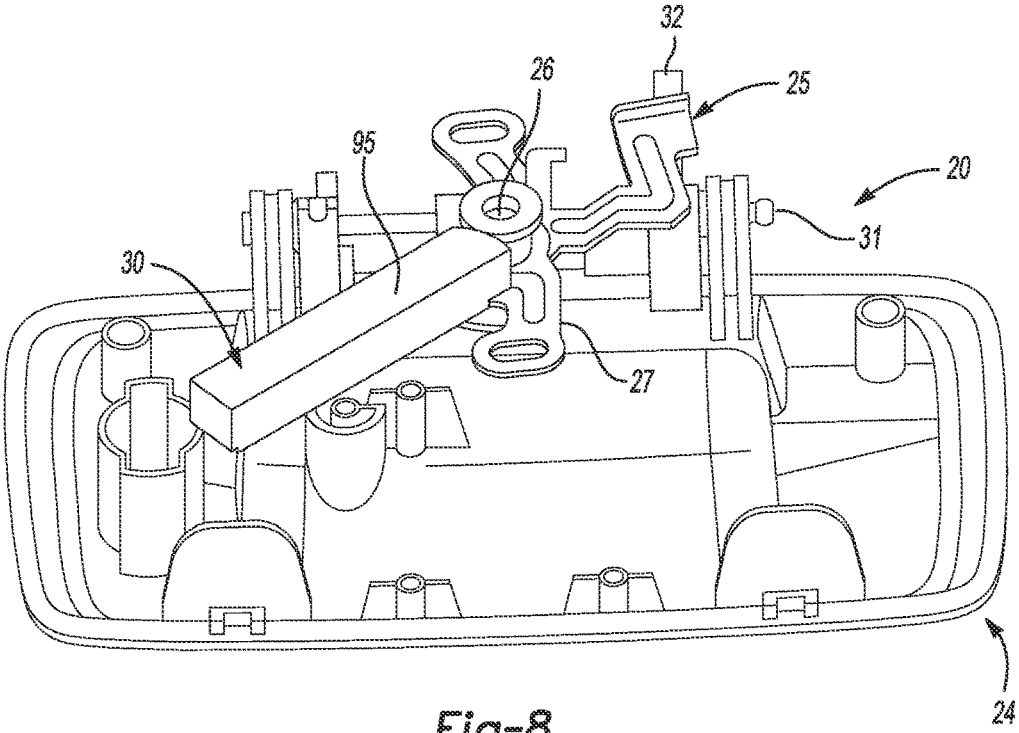
FIG. 8 is another bottom perspective view of the example of the closure release device depicted in FIG. 4.

The example of the SMA actuator 30 depicted in FIGS. 2-8 still further includes a push rod 50 extending from the shuttle 43 over the return spring 48 to a limit switch 51 slidingly disposed on the bulkhead 47. The push rod 50 may be electrically conductive. The limit switch 51 may open when the SMA wires 46 reach a stroke limit to prevent over stressing of the SMA wires 46. The SMA actuator 30 may have a cover 95 as depicted in FIG. 8.

FIGS. 9-14B depict examples of closure release devices that are compatible with a key cylinder lock according to the present disclosure. As depicted in FIGS. 9-14B, the closure release device 20' includes a housing 24' fixedly attached to the closure 22. (See FIG. 1.) The closure release device 20' includes a handle 29 rotatably attached to the housing 24'. The handle 29 is to be grasped and pulled (e.g. by a person) to unlatch the closure 22 and allow the closure 22 to be opened. An actuating lever 25' is rotatably disposed on an axis of rotation 26 on the housing 24'. The actuating lever 25' is spring-biased to a rest position. The rest position of the actuating lever 25' corresponds to a released position of the handle 29. The released position of the handle 29 is opposite to a pulled position of the handle 29. A crank lever 27' is rotatably disposed on the axis of rotation 26. A coupling member 28' is to selectively couple the actuating lever 25' to the crank lever 27' for rotation together.

When the handle 29 is pulled (see FIG. 1), the handle 29 rotates about the pivot pin 31 (see FIG. 9), thereby causing the handle lever arm 32 to rotate against the actuating lever 25'. When the coupling member 28' is in the unlocked position shown in FIG. 10, the coupling member 28' engages the crank lever 27' and causes the crank lever 27' to rotate with the actuating lever 25'. As the actuating lever 25' is rotated from the retracted state to the fully actuated state, the crank lever 27' rotates, and the latch rods 23, 23' are actuated, thereby causing the latch bolts 19, 19' to disengage from the strikers 21, 21' and allowing the closure 22 to open. (See also FIG. 1.) When the coupling member 28' is in the locked position shown in in FIG. 9, the coupling member 28' is positioned to allow the actuating lever 25' to rotate independently from the crank lever 27'. Therefore, in the example depicted in FIGS. 9-14B, when the coupling member 28' is in the locked position (shown in FIG. 9) and the handle 29 is pulled, the handle 29 will move and the actuating lever 25' will rotate, but the crank lever 27' will not rotate and the latch bolts 19, 19' will remain engaged with strikers 21, 21', thereby keeping the closure 22 closed.

In the examples depicted in FIGS. 9-14B, the coupling member 28' is a rocker arm pivotally attached to a key crank 52 at a pin joint 60. The pin joint 60 is on an end of a rocker driver arm 61 defined on the key crank 52. The key crank 52 is pivotally connected to the housing 24' at a key crank axis 59. The key crank 52 has a fork arm 53 to receive a key finger 54. The fork arm 53 has a two-tined fork 58 at a fork end 57 distal to the key crank axis 59. When a key 55 is turned in a key cylinder 56, the key finger 54 engages with the two-tined fork 58 and causes the key crank 52 to rotate about the key crank axis 59. The coupling member 28' has a slider end 62 opposite the pin joint 60. The slider end 62 slides in a first slot 65 in a first slotted arm 63 defined in the crank lever 27'. The actuating lever 25' has a second slot 66 in a second slotted arm 64. The reference indicator for the second slotted arm 64 is shown in dashed line format in FIGS. 9 and 10 to indicate that the second slotted arm 64 is hidden behind the first slotted arm 63. The first slot 65 has an inner end 67 that is closer to the axis of rotation 26 than an outer end 68 opposite the inner end 67. The second slot 66 has an inner end 67' and an outer end 68' that underlay the inner end 67 and outer end 68 of the first slot 65. The first slot 65 and the second slot 66 may be aligned such that the slider end 62 of the coupling member 28' connects the actuating lever 25' and the crank lever 27' for selectable co-rotation.

Figure 9:
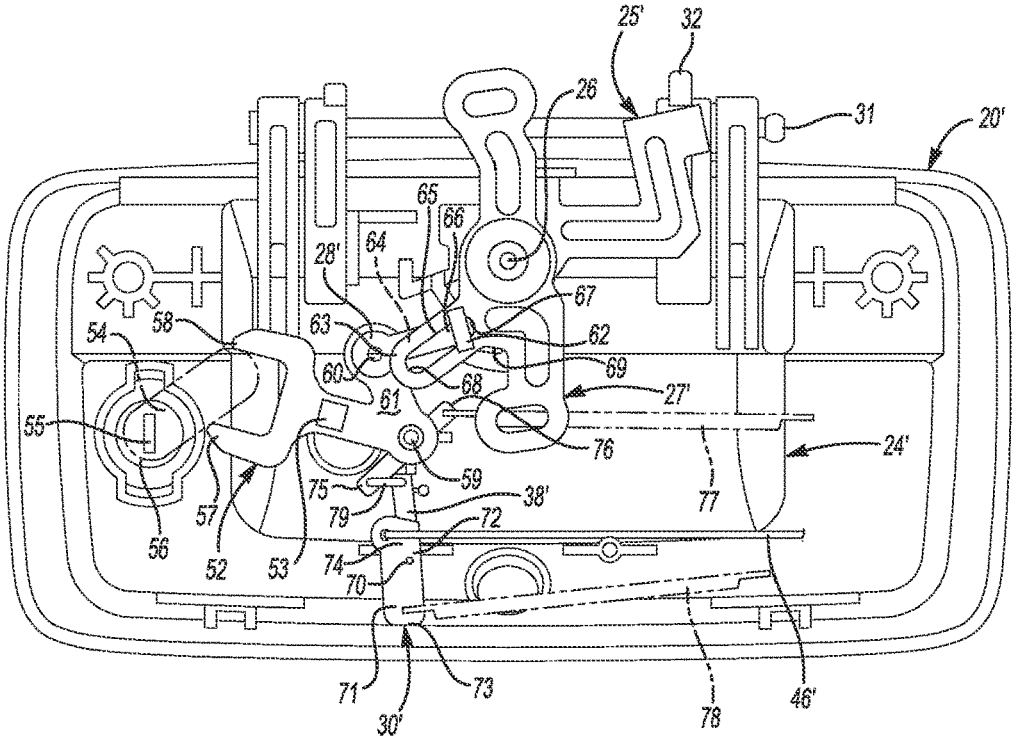
FIG. 9 is a front view of another example of a closure release device according to the present disclosure, depicted in a locked state.
Figure 10:
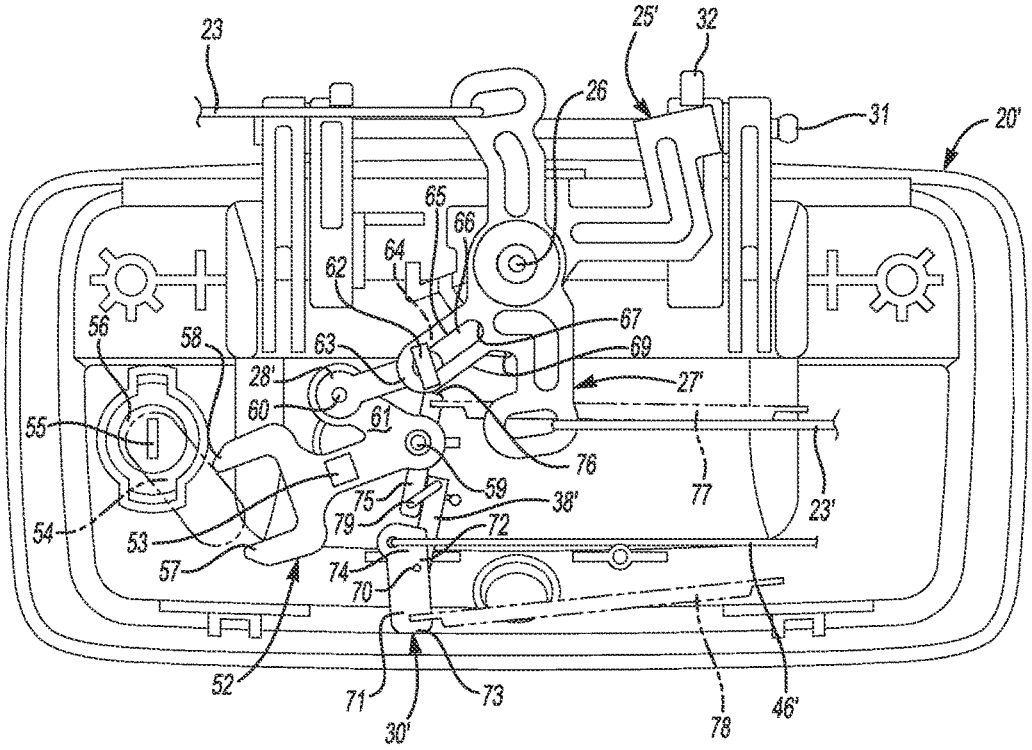
FIG. 10 is a front view of the example of the closure release device of FIG. 9 depicted in an unlocked state.
Figure 11:
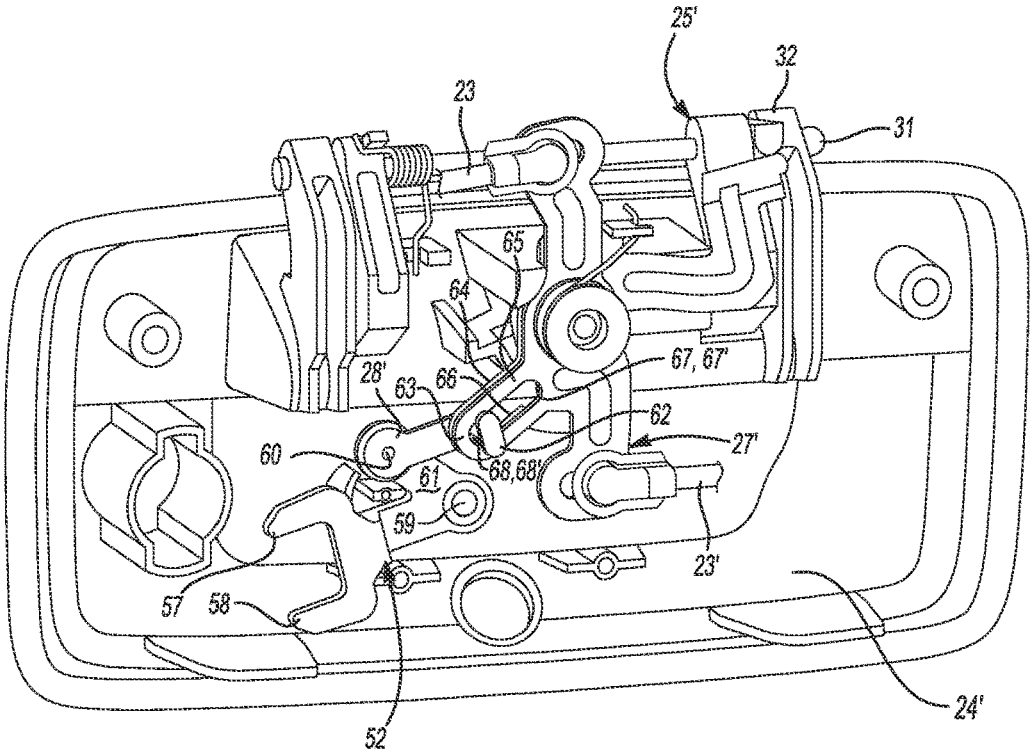
FIG. 11 is a perspective view of the example of the closure release device of FIG. 9 depicted in the unlocked state with no SMA actuator.
Figure 12:
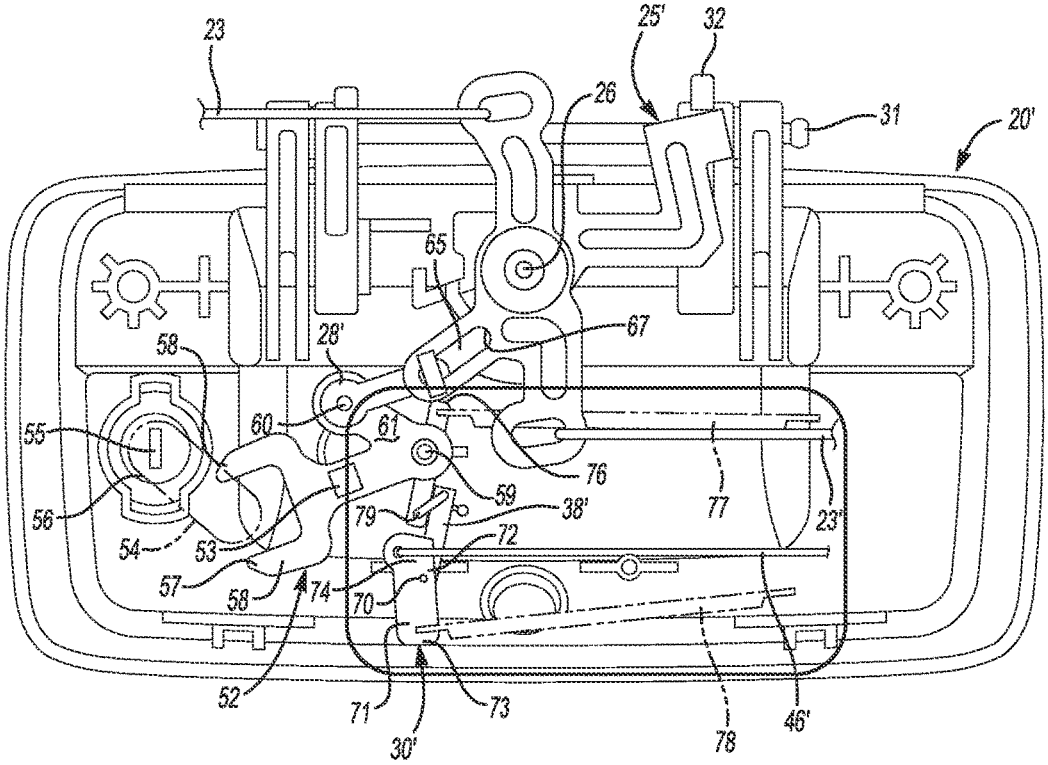
FIG. 12 is a front view of the example of the closure release device of FIG. 9 depicted in the unlocked state.
Figure 13:
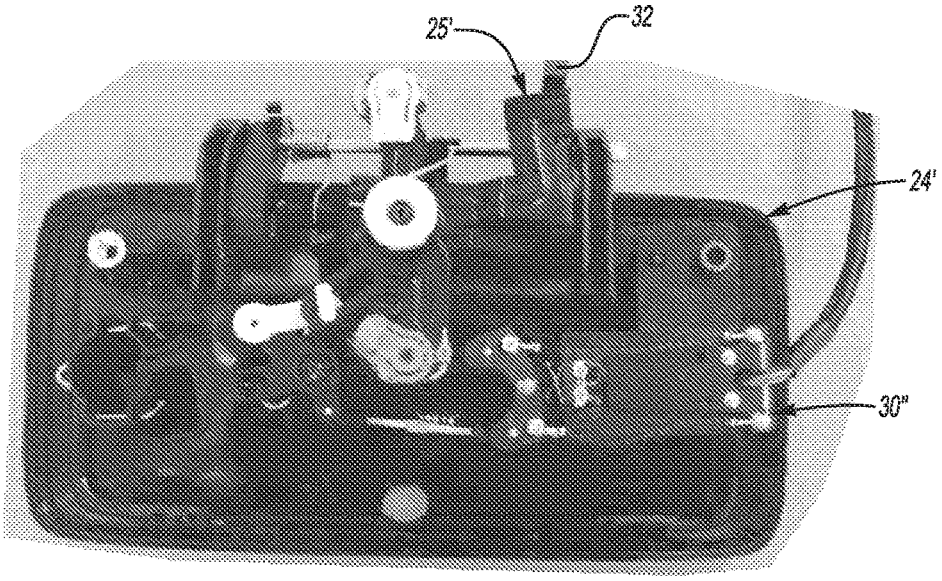
FIG. 13 is a front view photograph of an example of a closure release device according to the present disclosure, with an SMA actuator module connected to the crank lever by a tie rod.

When the key crank 52 is rotated counterclockwise as shown in FIG. 10, the slider end 62 is caused to slide to the outer end 68 of the first slot 65 and a corresponding portion of the second slot 66. When the key crank 52 is rotated clockwise as shown in FIG. 9, the slider end 62 is caused to slide to the inner end 67 of the first slot 65. An arc slot 69 is defined in the actuating lever 25'. The arc slot 69 is centered at the axis of rotation 26. The arc slot 69 intersects with the second slot 66 at the inner end 67'. Since the arc slot 69 is at the inner end 67' of the second slot 66, when the slider end 62 of the coupling member 28' is at the inner end 67 of the first slot 65, the actuating lever 25' is independently rotatable with respect to the crank lever 27' and the slider end 62 slides in the arc slot 69.

In the examples of the present disclosure depicted in FIGS. 9-14B, the SMA actuator 30' is to selectively cause the coupling member 28' to selectively couple the actuating lever 25' to the crank lever 27'. The SMA actuator 30' is electrically actuated. The crank lever 27' is to connect to a latch 33 to selectively release or engage the latch 33 in response to a coupling state of the actuating lever 25' with the crank lever 27' and an actuation state of the actuating lever 25'. In the example depicted in FIGS. 9-14B, the coupling state of the actuating lever 25' with the crank lever 27' is either "coupled" or "uncoupled". The coupling state is "coupled" when the coupling member 28' is in the "unlocked" position as depicted in FIG. 10. To clarify, the "unlocked" position does not imply that the actuating lever 25' is "locked" to the crank lever 27'. In this context, "unlocked" means that the closure 22 may be opened by pulling on the handle 29. Conversely, the coupling state is "uncoupled" when the coupling member 28' is in the "locked" position as depicted in FIG. 10. In this context, "locked" means that the closure 22 does not open when the handle 29 is pulled. The SMA actuator 30', 30" depicted in FIGS. 9-15D drives the key crank 52.

In the example depicted in FIGS. 9-12, the SMA actuator 30' includes a rocker 71 pivotally connected to the housing 24' at a rocker pivot 70. The rocker 71 defines a lock arm 72 and an unlock arm 73 opposite the lock arm 72. The rocker pivot 70 is between the lock arm 72 and the unlock arm 73. An indexing arm 38' also pivots about the rocker pivot 70. The indexing arm 38' is rotationally driven by the rocker 71 via a push-push connection 74. The key crank 52 defines a first control arm 75 extending radially from the key crank axis 59. A key crank 52 also defines a second control arm 76 extending radially from the key crank axis 59 in a direction opposite to the first control arm 75. A lock return spring 77 is connected to the second control arm 76 and anchored to the housing 24' to bias the key crank 52 toward the "locked" position as depicted in FIG. 9. An SMA extension spring 78 is connected to the lock arm 72 of the rocker 71 and anchored to the housing 24'. Contraction of the SMA extension spring 78 urges the lock arm 72 of the rocker 71 and the indexing arm 38' toward the first control arm 75 of the key crank 52. An SMA wire 46' is connected to the unlock arm 73 of the rocker 71 and anchored to the housing 24'. Activation/contraction of the SMA wire 46' rotates the rocker 71 and the indexing arm 38' away from the first control arm 75 of the key crank 52. An overload protection spring 79 connects the indexing arm 38' to the first control arm 75 of the key crank 52. As the indexing arm 38' rotates away from the first control arm 75, tension is applied to the first control arm 75 via the overload protection spring 79 to cause an unlocking torque on the key crank 52.

In the example depicted in FIGS. 13-15D, the SMA actuator 30" is arranged in an SMA actuator module 80. The SMA actuator module 80 has a substrate 35' that is attachable to the housing 24' as depicted in FIGS. 14A and 14B. The SMA actuator module 80 includes a rocker 71' pivotally connected to the substrate 35' at a rocker pivot 70'. The rocker 71' defines a lock arm 72' and an unlock arm 73' opposite the lock arm 72'. The rocker pivot 70' is between the lock arm 72' and the unlock arm 73'. A tie rod 81 is connected to the rocker 71' from the unlock arm 73'. The key crank 52 defines an actuation arm 82 extending radially from the key crank axis 59. The tie rod 81 connects the unlock arm 73' of the rocker 71' to the actuation arm 82 of the key crank 52. A first SMA actuation spring 83 is connected to the unlock arm 73' and anchored to the substrate 35' to bias the unlock arm 73' toward the "unlocked" position.

When the first SMA actuation spring 83 is activated, the tension in the first SMA actuation spring 83 increases and the rocker 71' pivots toward the "unlocked" position. A second SMA actuation spring 84 is connected to the lock arm 72' and anchored to the substrate 35' to bias the lock arm 72' toward the "locked" position as shown in FIG. 14A.

Figure 14A:
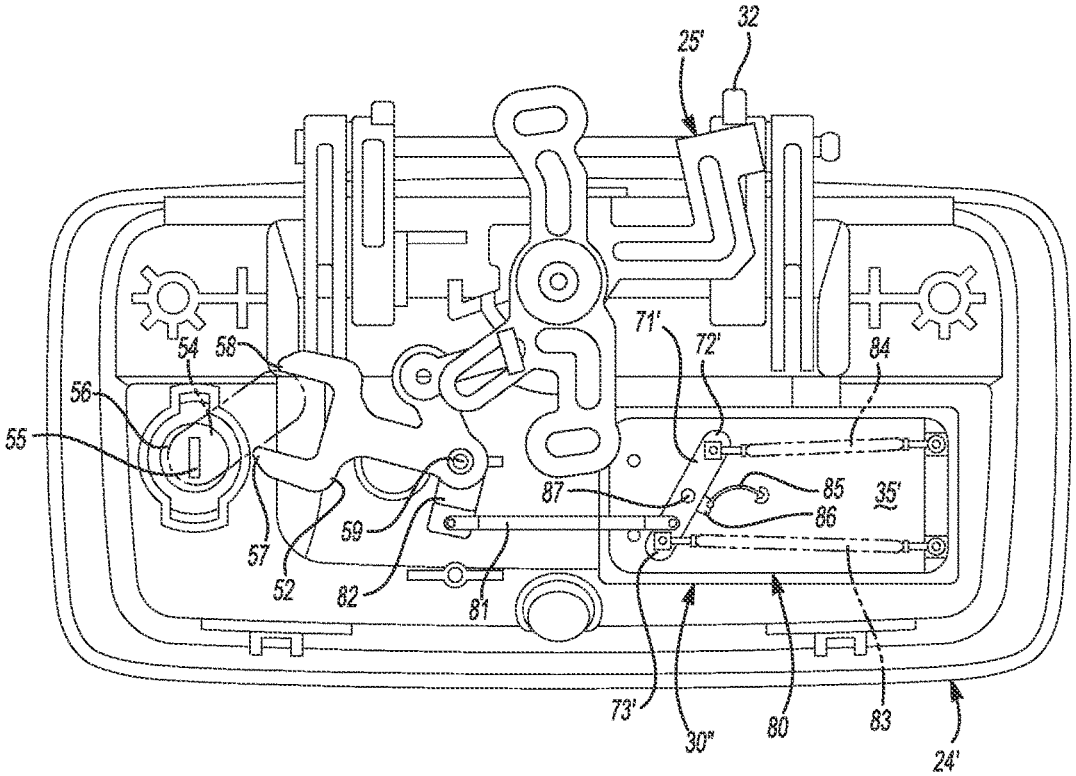
FIG. 14A is a front view drawing of the example of the closure release device depicted in FIG. 13.
Figure 14B:
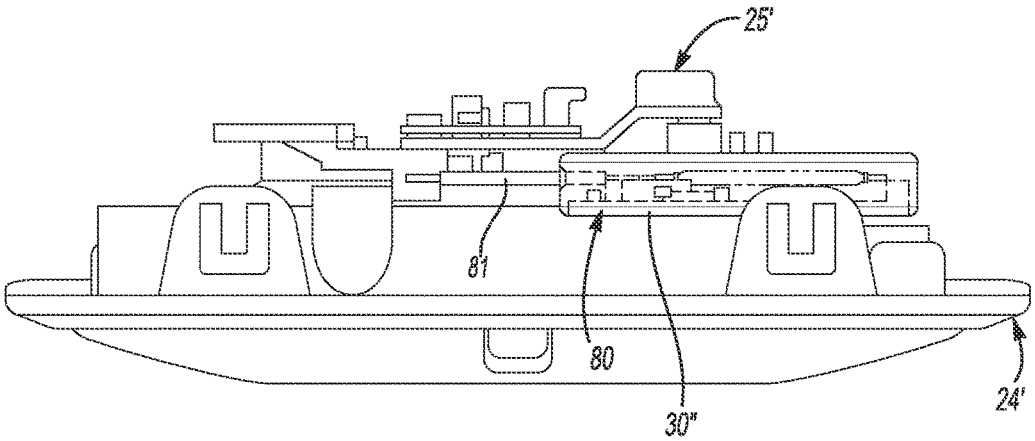
FIG. 14B is a bottom view of the example of the closure release device depicted in FIG. 14A.
Figure 15A:
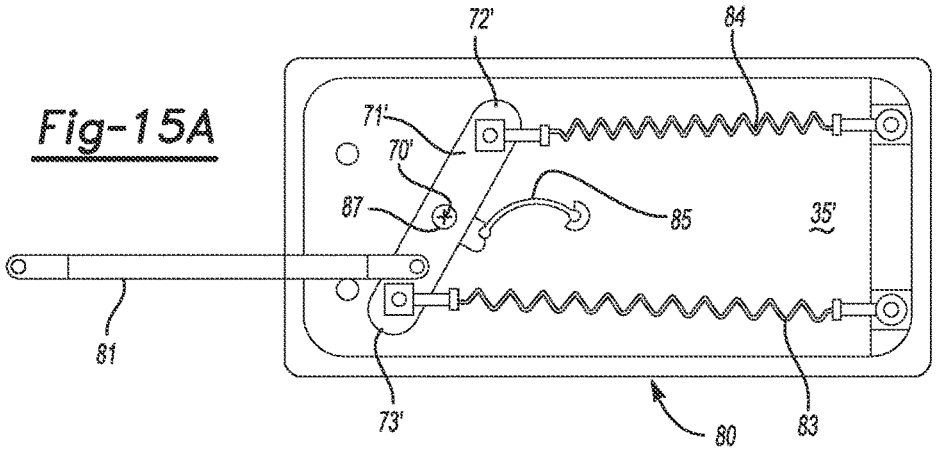
FIG. 15A is a front view of the example of the SMA actuator module depicted in FIGS. 14A and 14B.
Figure 15B:
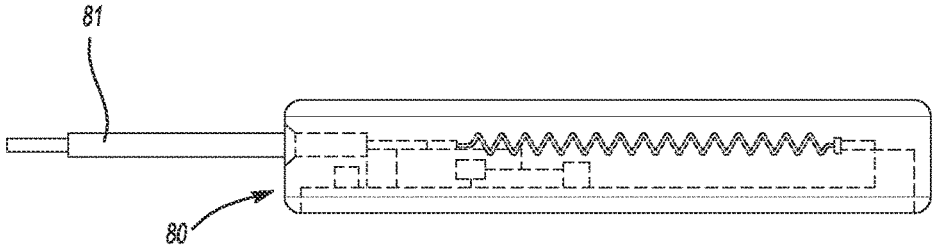
FIG. 15B is a bottom view of the example of the SMA actuator module depicted in FIG. 15A.
Figure 15C:
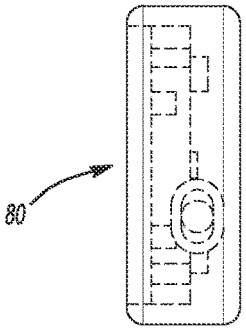
FIG. 15C is a left view of the example of the SMA actuator module depicted in FIG. 15A.
Figure 15D:
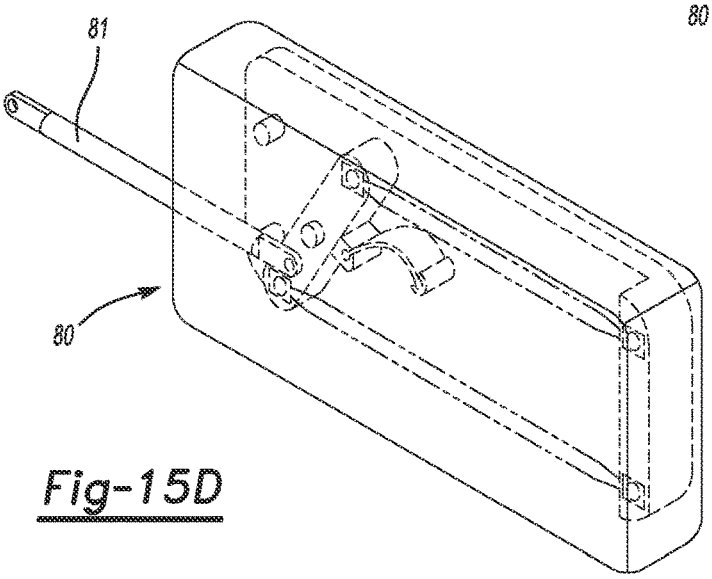
FIG. 15D is a right front perspective view of the example of the SMA actuator module depicted in FIG. 15A.

When the second SMA actuation spring 84 is activated, the tension in the second SMA actuation spring 84 increases and the rocker 71' pivots toward the "locked" position as shown in FIG. 14A. The first SMA actuation spring 83 is antagonistic to the second SMA actuation spring 84. When the first SMA actuation spring 83 is activated (for example by running electric current through the first SMA actuation spring 83 and causing Joule heating) the first SMA actuation spring 83 overcomes the unactivated (i.e., cooler) second SMA actuation spring 84 and the rocker 71' pivots toward the "unlocked" position. When the rocker 71' pivots toward the "unlocked" position, the tie rod 81 pulls on the actuation arm 82 of the key crank 52 and rotates the key crank 52 to the "unlocked" position.

When the key crank 52 is in the "unlocked" position, the coupling member 28' slides to the "unlocked" position shown in FIG. 10. When the second SMA actuation spring 84 is activated (for example by running electric current through the second SMA actuation spring 84 and causing Joule heating) the second SMA actuation spring 84 overcomes the unactivated (i.e. cooler) first SMA actuation spring 83 and the rocker 71' pivots toward the "locked" position. When the rocker 71' pivots toward the "locked" position, the tie rod 81 pushes on the actuation arm 82 of the key crank 52 and rotates the key crank 52 to the "locked" position shown in FIG. 14A. When the key crank 52 is in the "locked" position, the coupling member 28' slides to the "locked" position shown in FIG. 14A and FIG. 9.

In examples of the present disclosure, the rocker 71 may be bistable in the "locked" and "unlocked" positions. A bow spring 85 is connected to a biasing arm 86 extending from a center 87 of the rocker 71' normal to the lock arm 72' and the unlock arm 73'. The bow spring 85 is anchored on the substrate 35'. The center location of the bow spring 85 and the biasing arm 86 cause the rocker 71' to be bistable in the "locked" and "unlocked" positions.

FIGS. 16-24B depict an example of a closure release device 20" according to the present disclosure, with no key cylinder lock. The closure release device 20" includes a housing 24 fixedly attached to the closure 22. The closure release device 20" includes a handle 29 rotatably attached to the housing 24. The handle 29 is to be grasped and pulled (e.g., by a person) to unlatch the closure 22 and allow the closure 22 to be opened. An actuating lever 25" is rotatably disposed on the axis of rotation 26 on the housing 24. The actuating lever 25" is spring-biased to a rest position. The rest position of the actuating lever 25" corresponds to a released position of the handle 29. The actuation state of the actuating lever 25" is "retracted" when in the rest position. The actuation state of the actuating lever 25" is "fully actuated" when the actuating lever 25" is rotated to the maximum extent away from the rest position. The actuating lever 25" is shown in the fully actuated state in FIG. 23B. The released position of the handle 29 is opposite to a pulled position of the handle 29. A crank lever 27" is rotatably disposed on the axis of rotation 26. A coupling member 28" is to selectively couple the actuating lever 25" to the crank lever 27" for rotation together.

When the handle 29 (see FIG. 1) is pulled to the pulled position, the handle 29 rotates about the pivot pin 31, thereby causing the handle lever arm 32 to rotate against the actuating lever 25". When the coupling member 28" is in the unlocked position shown in FIG. 19B, the coupling member 28" engages the actuating lever 25" and causes the crank lever 27" to rotate with the crank lever 27". As the actuating lever 25" is rotated from the retracted state to the fully actuated state, the crank lever 27" rotates, and the latch rods 23, 23' are actuated, thereby causing the latch bolts 19, 19' to disengage from the strikers 21, 21' and allowing the closure 22 to open. (See also FIG. 1.) When the coupling member 28" is in the locked position shown in in FIG. 19A, the coupling member 28" disengages from the crank lever 27" and allows the actuating lever 25" to rotate independently from the crank lever 27". Therefore, in the example depicted in FIGS. 16-24B, when the coupling member 28" is in the locked position (shown in FIG. 19A) and the handle 29 is pulled, the handle 29 will move and the actuating lever 25" will rotate, but the crank lever 27" will not rotate and the latch bolts 19, 19' will remain engaged with strikers 21, 21' thereby keeping the closure 22 closed.

Figure 16:
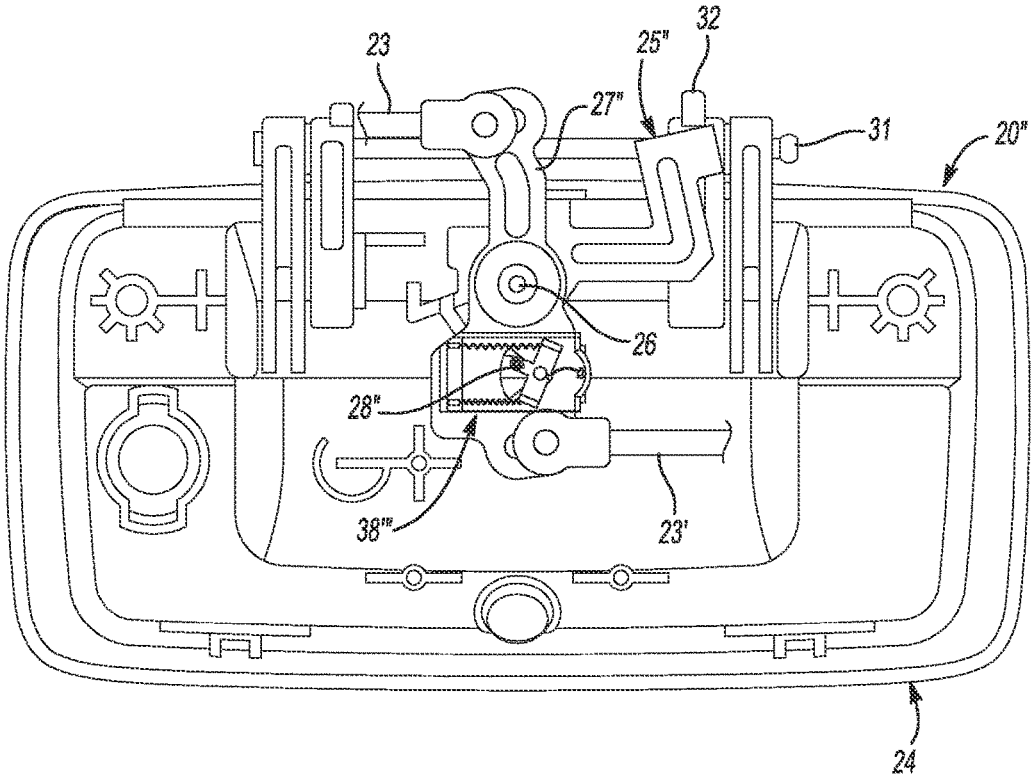
FIG. 16 is a front view of a further example of a closure release device according to the present disclosure.
Figure 17:
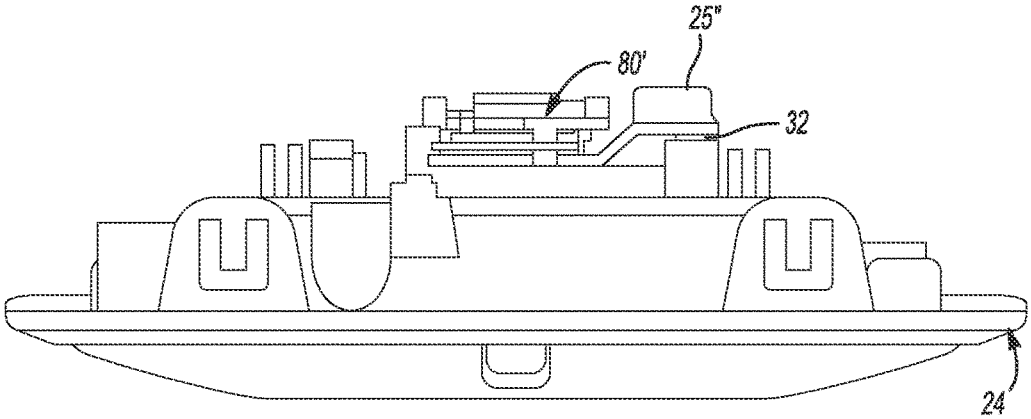
FIG. 17 is a bottom view of the example of the closure release device depicted in FIG. 16.

In the example depicted in FIGS. 16-24B, the SMA actuator 30'" is arranged in an SMA actuator module 80'. The SMA actuator module 80' has a substrate 35" disposed in an enclosure 88 that is attachable to the crank lever 27" as depicted in FIG. 16. The SMA actuator module 80' includes a rocker 71" pivotally connected to the substrate 35" at a rocker pivot 70". The rocker 71" defines a lock arm 72" and an unlock arm 73" opposite the lock arm 72". The rocker pivot 70" is between the lock arm 72" and the unlock arm 73". The rocker 71" defines the coupling member 28" extending perpendicularly from the rocker pivot 70". The actuating lever 25" defines a hook 90 extending from the axis of rotation 26 to engage with the coupling member 28" when the rocker 71" is in the "unlocked" position (shown in FIG. 19B). A first SMA actuation spring 83' is connected to the unlock arm 73" and anchored to the substrate 35" to bias the unlock arm 73" toward the "unlocked" position corresponding to the coupled state. When the first SMA actuation spring 83' is electrically activated, the tension in the first SMA actuation spring 83' increases and the rocker 71" pivots toward the "unlocked" position.

Figure 19A:
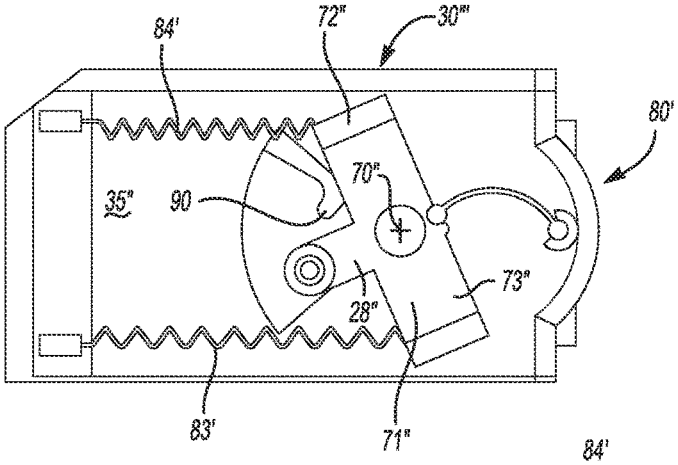
FIG. 19A is a front view of the example of the SMA actuator module of FIG. 16 shown in a locked state.
Figure 19B:
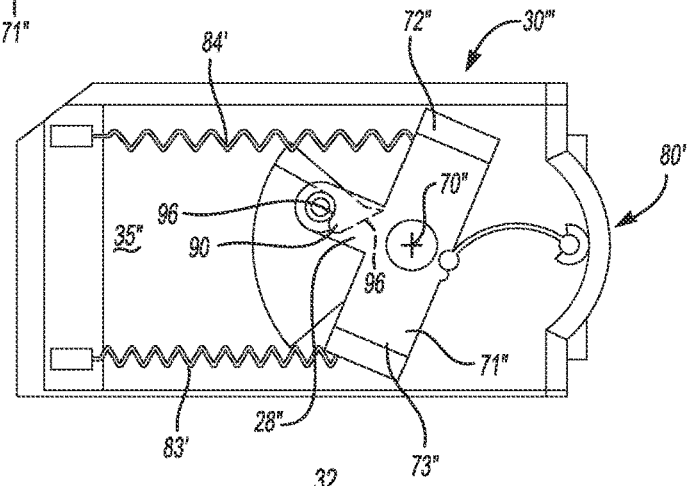
FIG. 19B is a front view of the example of the SMA actuator module of FIG. 16 shown in an unlocked state.
Figure 20:
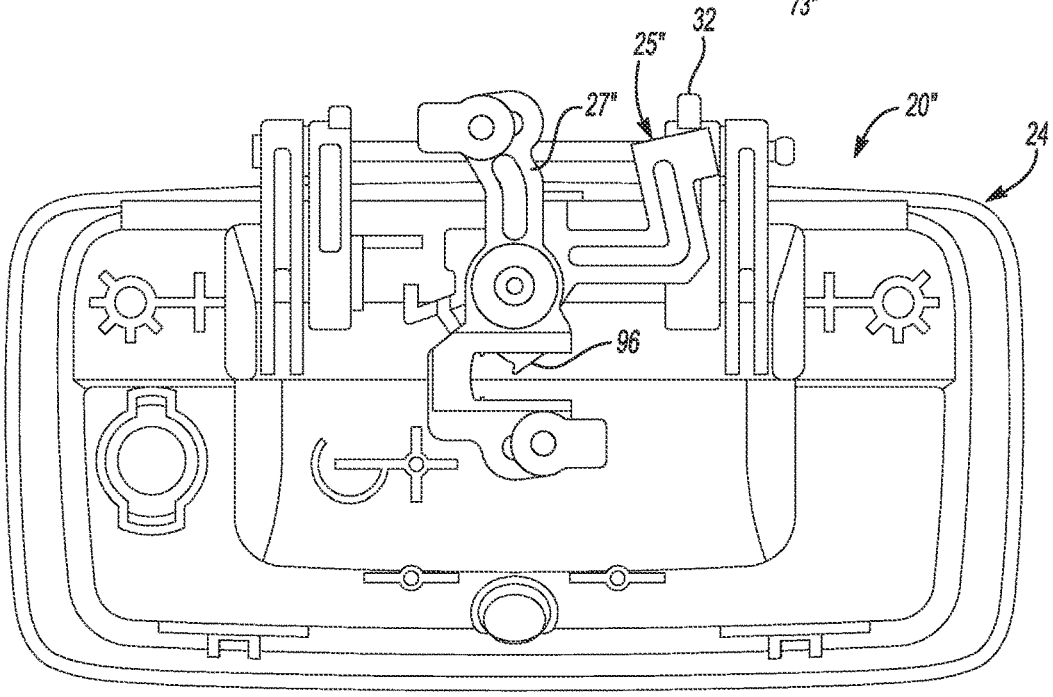
FIG. 20 is a front view of the example of the closure release device of FIG. 16 with the SMA actuator module partially removed.
Figure 21:
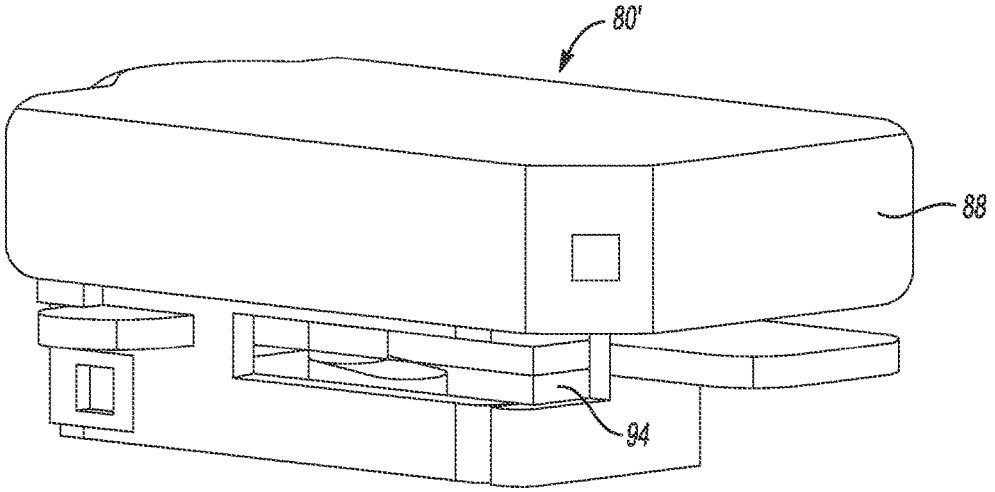
FIG. 21 is a perspective view of the example of the SMA actuator module of FIG. 16.

A second SMA actuation spring 84 is connected to the lock arm 72" and anchored to the substrate 35" to bias the lock arm 72" toward the "locked" position as shown in FIG. 19A. When the second SMA actuation spring 84' is activated, the tension in the second SMA actuation spring 84' increases and the rocker 71" pivots toward the "locked" position as shown in FIG. 19A. The first SMA actuation spring 83' is antagonistic to the second SMA actuation spring 84'. When the first SMA actuation spring 83' is activated (for example by running electric current through the first SMA actuation spring 83' and causing Joule heating) the first SMA actuation spring 83' overcomes the unactivated (i.e., cooler) second SMA actuation spring 84' and the rocker 71" pivots toward the "unlocked" position (shown in FIG. 19B). When the rocker 71" pivots toward the "unlocked" position, the coupling member 28" rotates to a position in a path 91 of the hook 90. (See FIG. 22A.) When the second SMA actuation spring 84' is activated (for example by running electric current through the second SMA actuation spring 84' and causing Joule heating) the second SMA actuation spring 84' overcomes the unactivated (i.e. cooler) first SMA actuation spring 83' and the rocker 71" pivots toward the "locked" position.

When the rocker 71" pivots toward the "locked" position, the coupling member 28" rotates to a position out of the path 91 of the hook 90. The hook 90 has a deflector ramp 96 to deflect the coupling member 28" and prevent the coupling member 28" from preventing the actuating lever 25" from returning to the rest position in the absence of the pulling force on the handle 29. For example, if i) the rocker 71" is in the "locked" position, ii) the handle 29 is pulled, iii) the first SMA actuation spring 83' is activated and the rocker 71" is pivoted to the unlocked position (FIG. 19B), iv) the handle 29 is released, in the order presented, the deflector ramp 96 will deflect the coupling member 28" out of the path 91 of the hook 90 and allow the actuating lever 25" to return to the rest position. After the hook 90 has passed by the coupling member 28", the coupling member 28" will return to the unlocked position to be engaged by the hook 90 if the handle 29 is pulled again.

Figure 18A:
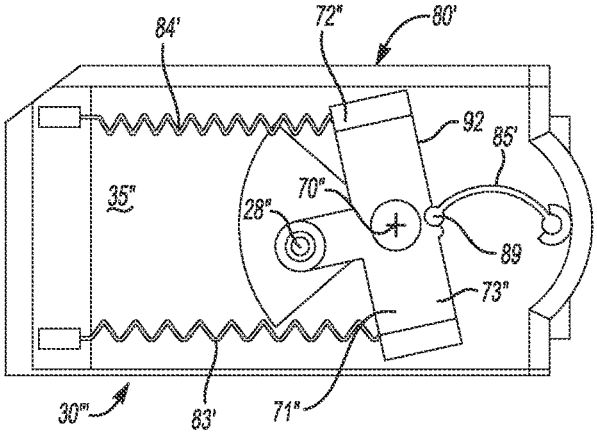
FIG. 18A is a front view of the example of the SMA actuator module depicted in FIG. 16.
Figure 18B:
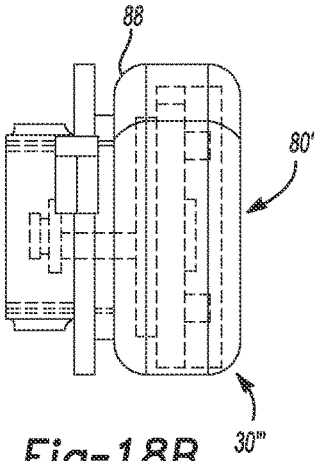
FIG. 18B is a right side view of the example of the SMA actuator module depicted in FIG. 18A.
Figure 18C:
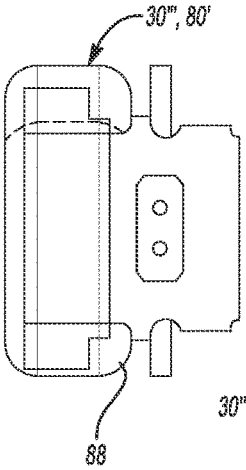
FIG. 18C is a left side view of the example of the SMA actuator module depicted in FIG. 18A.
Figure 18D:
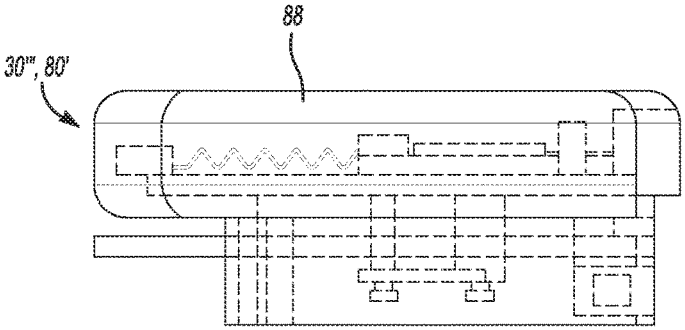
FIG. 18D is a bottom view of the example of the SMA actuator module depicted in FIG. 18A.
Figure 18E:
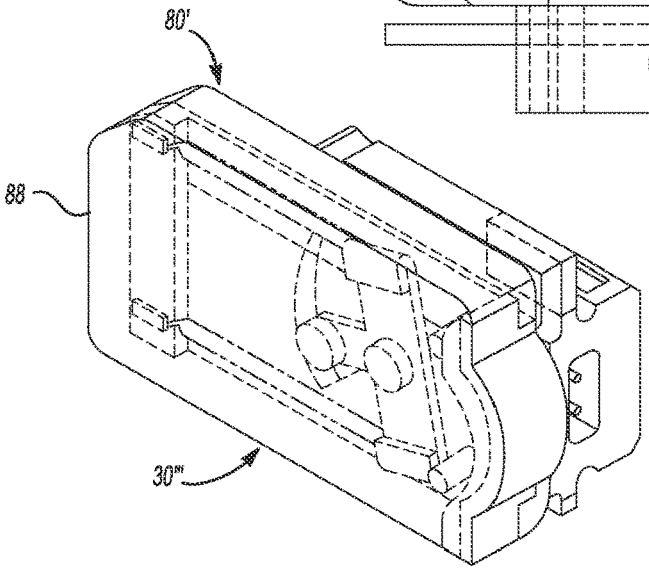
FIG. 18E is a right front perspective view of the example of the SMA actuator module depicted in FIG. 18A.

As illustrated in FIG. 18A, a bow spring 85' is connected to the rocker 71" at an edge attachment point 89 of the rocker 71". The edge attachment point 89 is on an edge 92 of the rocker 71" where the edge 92 intersects a line perpendicular to the rocker 71" and through the rocker pivot 70". The bow spring 85' is anchored on the substrate 35". The center location of the bow spring 85' and the attachment point 89 cause the rocker 71" to be bistable in the "locked" and "unlocked" positions.

The SMA actuator module 80' depicted in FIGS. 16-24B is miniaturized compared to the SMA actuator module 80 depicted in FIGS. 13-15D. The kinematic arrangement using the miniaturized SMA actuator module 80' requires about $1/6^{th}$ of the work of SMA actuator module 80 shown in FIGS. 13-15D. A smaller wire diameter in the first SMA actuation spring 83' and the second SMA actuation spring 84' allows the miniaturized SMA actuator module 80' to have quicker activation and cooling times. The miniaturized SMA actuator module 80' only needs two pins that switch polarity to lock/unlock. The closure release device 20" shown in FIGS. 16-24B eliminates the key cylinder 56 that was included in the examples shown in FIGS. 9-15D.

FIGS. 22A-24B depict an example of the present disclosure configured to seal between the actuating lever 25" and the enclosure 88 of the miniaturized SMA actuator module 80' according to the present disclosure. The actuating lever 25" has a constant radius 93 to always be engaged on all parts of the seal 94. The actuating lever 25" slides along the seal 94 but does not leave any openings for water or dust intrusion.

Figure 22A:
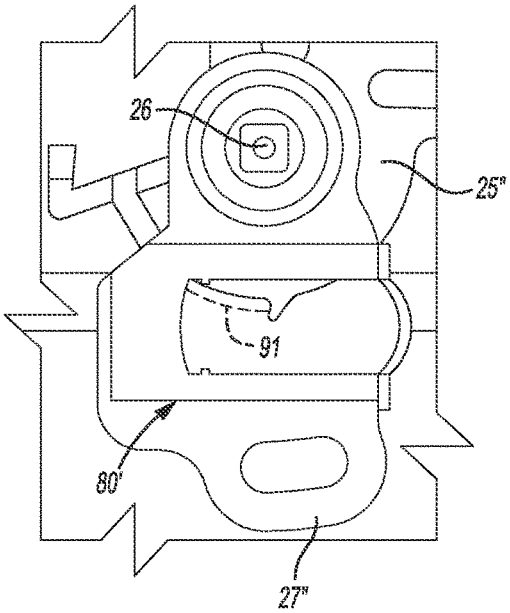
FIG. 22A is a front cutaway view of the example of the SMA actuator module and closure release device of FIG. 16, depicting the actuating lever with a hook in the fully retracted state.
Figure 22B:
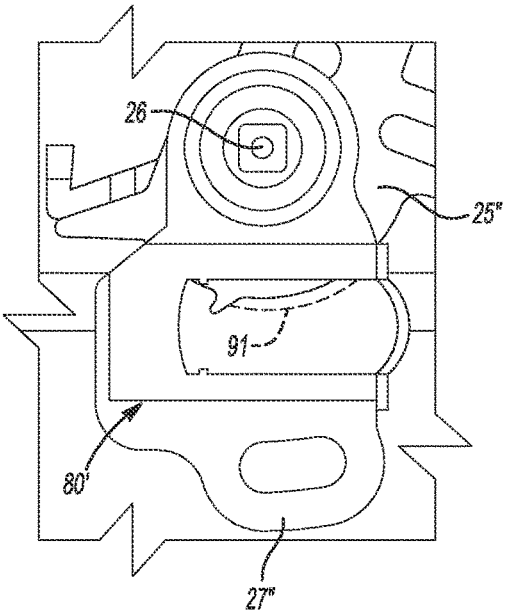
FIG. 22B is a front cutaway view of the example of the SMA actuator module and closure release device of FIG. 16 depicting the actuating lever with the hook in the fully actuated state.

FIG. 22A is a front cutaway view of the example of the SMA actuator module 80' shown in FIG. 16 depicting the actuating lever 25" with the hook 90 in the fully retracted state; and FIG. 22B is a front view of the actuating lever 25" with the actuating lever 25" in a fully actuated state with the SMA actuator module 80' in the locked state.

Figure 23A:
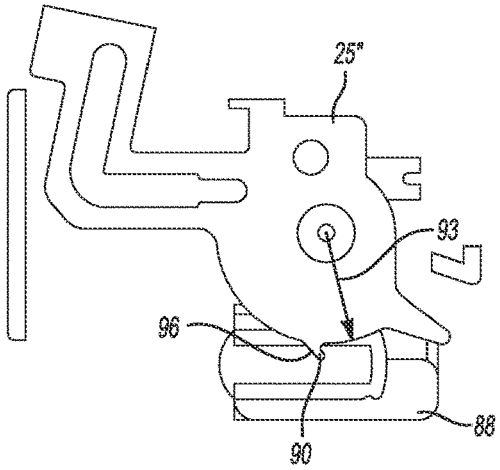
FIG. 23A is a rear detail view of the actuating lever shown in FIG. 22A in the fully retracted state.
Figure 23B:
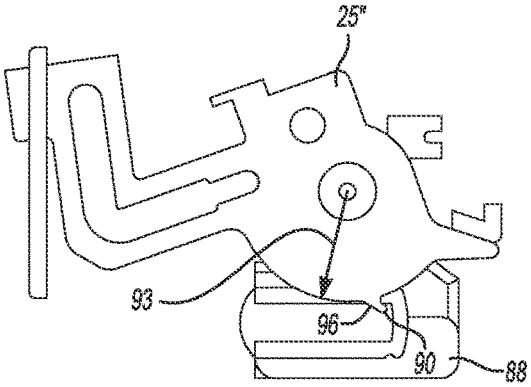
FIG. 23B is a rear detail view of the actuating lever shown in FIG. 22B in the fully actuated state.

FIG. 23A is a rear detail view of the actuating lever 25" in the fully retracted state; and FIG. 23B is a rear detail view of the actuating lever 25" in the fully actuated state with the SMA actuator module 80' in the locked state.

Figure 24A:
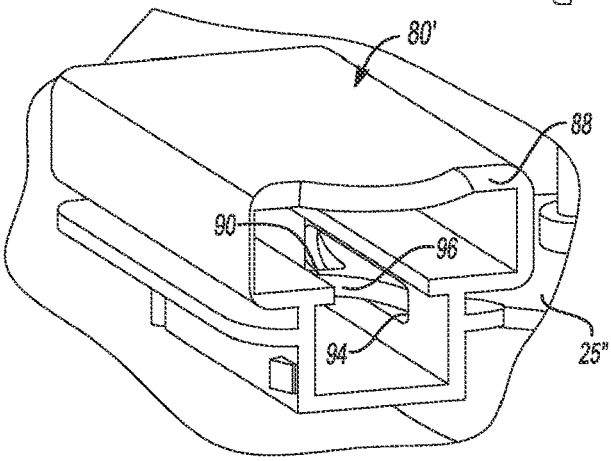
FIG. 24A is a cutaway view of the example of the SMA actuator module of FIG. 16 installed on the crank lever showing the hook with the actuating lever in the fully retracted state.
Figure 24B:
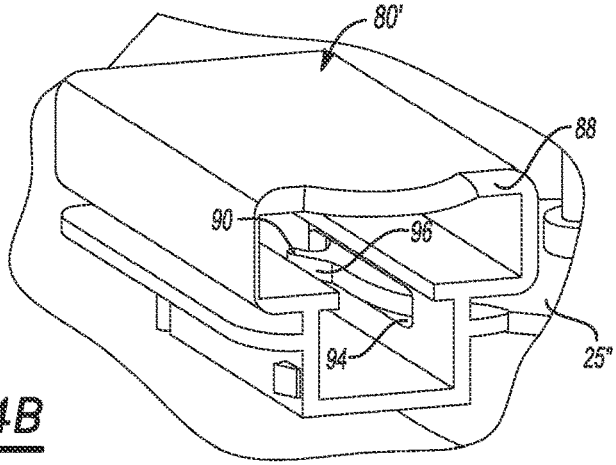
FIG. 24B is a cutaway view of the example of the SMA actuator module of FIG. 16 installed on the crank lever depicting the hook with the actuating lever in the fully actuated state.

FIG. 24A is a cutaway view of the example of the miniaturized SMA actuator module 80' installed on the actuating lever 25" depicting the hook 90 with the actuating lever 25" in the fully refracted state. FIG. 24B is a cutaway view of the miniaturized SMA actuator module 80' depicting the hook 90 with the actuating lever 25" in the fully actuated state with the SMA actuator module 80' in the locked state.

The SMA actuators 30, 30', 30", 30'" are compatible with nominal 12V vehicle electrical systems, having a range of from about 9V to about 16V. It is to be understood that the SMA actuators 30, 30', 30", 30'" may also be compatible with nominal 24V and 48V vehicle electrical systems.

It is to be understood that the ranges provided herein include the stated range and any value or sub-range within the stated range. For example, a range from about 9V to about 16V should be interpreted to include not only the explicitly recited limits of about 9V to about 16V, but also to include individual values, such as 10V, 10.5V, 15V, etc., and sub-ranges, such as from about 10V to about 11V; from about 9.8V to about 15.2V, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it is to be understood that the disclosed examples may be modified. Therefore, the foregoing description is to be considered non-limiting.

The invention claimed is:

1. A closure release device, comprising:

a housing fixedly attached to a closure;

an actuating lever rotatably disposed on an axis of rotation on the housing;

a crank lever rotatably disposed on the axis of rotation;

a coupling member to selectively couple the actuating lever to the crank lever for rotation therewith;

a shape memory alloy (SMA) actuator to selectively cause the coupling member to selectively couple the actuating lever to the crank lever wherein the SMA actuator is electrically actuated, and the crank lever is to connect to a latch to selectively release or engage the latch in response to a coupling state of the actuating lever with the crank lever and an actuation state of the actuating lever;

an SMA actuator module attachable to the crank lever, the SMA actuator module including an enclosure having the SMA actuator arranged therein; and a seal disposed on the SMA actuator module to seal against the actuating lever wherein the actuating lever presents a constant radius at an interface with the seal to maintain contact between the seal and the actuating lever during movement of the actuating lever, wherein the coupling state has a coupled state corresponding to an unlocked state of the closure, and wherein the coupling state has an uncoupled state corresponding to a locked state of the closure.

2. The closure release device as defined in claim 1 wherein the SMA actuator module includes:

a substrate disposed in the enclosure;

a rocker pivotally connected to the substrate at a rocker pivot;

a lock arm defined by the rocker;

an unlock arm defined by the rocker opposite the lock arm wherein the rocker pivot is between the lock arm and the unlock arm;

the coupling member defined by the rocker, the coupling member extending perpendicularly from the rocker pivot;

a first SMA actuation spring connected to the unlock arm and anchored to the substrate to bias the unlock arm toward an unlocked position corresponding to the coupled state; and a second SMA actuation spring connected to the lock arm and anchored to the substrate to bias the lock arm toward a locked position corresponding to the uncoupled state.

3. The closure release device as defined in claim 2 wherein:

the first SMA actuation spring is to increase tension in the first SMA actuation spring when electrically activated to cause the rocker to pivot toward the unlocked position corresponding to the coupled state; and the second SMA actuation spring is to increase tension in the second SMA actuation spring when electrically activated to cause the rocker to pivot toward the locked position corresponding to the uncoupled state.

4. The closure release device as defined in claim 3 wherein:

the first SMA actuation spring is antagonistic to the second SMA actuation spring through the rocker; and the first SMA actuation spring and the second SMA actuation spring are to be activated separately and exclusively to alternatively cause i) the first SMA actuation spring in a first activated state to overcome the second SMA actuation spring in a second unactivated state thereby to pivot the rocker to the unlocked position corresponding to the coupled state; or ii) the second SMA actuation spring in a second activated state to overcome the first SMA actuation spring in a first unactivated state thereby to pivot the rocker to the locked position corresponding to the uncoupled state.

5. The closure release device as defined in claim 2, wherein a hook is defined by the actuating lever, the hook to extend from the axis of rotation to engage with the coupling member when the rocker is in the unlocked position corresponding to the coupled state.

6. The closure release device as defined in claim 5, further comprising a handle rotatably attached to the housing, the handle to be grasped and pulled wherein:

the handle is to rotate to a pulled position in response to a pulling force exerted on the handle;

the handle is to return to a released position in an absence of the pulling force on the handle; and the hook has a deflector ramp to deflect the coupling member and prevent the coupling member from preventing the actuating lever from returning to a rest position in the absence of the pulling force on the handle.

7. The closure release device as defined in claim 2 wherein the rocker is bistable in the locked position and the unlocked position.

8. The closure release device as defined in claim 2 wherein:

a bow spring is connected to the rocker at an edge attachment point of the rocker;

the edge attachment point is located on an edge of the rocker where the edge intersects a line perpendicular to the rocker and through the rocker pivot;

the bow spring is anchored on the substrate; and the bow spring causes the rocker to be bistable in the locked position and the unlocked position.

9. A vehicle tailgate, comprising:

a tailgate release device mounted on the vehicle tailgate, including:

a housing fixedly attached to a vehicle tailgate;

an actuating lever rotatably disposed on an axis of rotation on the housing;

a crank lever rotatably disposed on the axis of rotation;

a coupling member to selectively couple the actuating lever to the crank lever for rotation therewith; and a shape memory alloy (SMA) actuator to selectively cause the coupling member to selectively couple the actuating lever to the crank lever, wherein:

the SMA actuator is electrically actuated, and the crank lever is to connect to a latch to selectively release or engage the latch in response to a coupling state of the actuating lever with the crank lever and an actuation state of the actuating lever;

the coupling state has a coupled state corresponding to an unlocked state of the vehicle tailgate; and the coupling state has an uncoupled state corresponding to a locked state of the vehicle tailgate;

an SMA actuator module attachable to the crank lever, the SMA actuator module including an enclosure having the SMA actuator arranged therein; and a seal disposed on the SMA actuator module to seal against the actuating lever wherein the actuating lever presents a constant radius at an interface with the seal to maintain contact between the seal and the actuating lever during movement of the actuating lever.

10. The vehicle tailgate as defined in claim 9 wherein the SMA actuator module includes:

a substrate disposed in the enclosure;

a rocker pivotally connected to the substrate at a rocker pivot;

a lock arm defined by the rocker;

an unlock arm defined by the rocker opposite the lock arm wherein the rocker pivot is between the lock arm and the unlock arm;

the coupling member defined by the rocker, the coupling member extending perpendicularly from the rocker pivot;

a first SMA actuation spring connected to the unlock arm and anchored to the substrate to bias the unlock arm toward an unlocked position corresponding to the coupled state; and a second SMA actuation spring connected to the lock arm and anchored to the substrate to bias the lock arm toward a locked position corresponding to the uncoupled state.

11. The vehicle tailgate as defined in claim 10 wherein:

the first SMA actuation spring is to increase tension in the first SMA actuation spring when electrically activated to cause the rocker to pivot toward the unlocked position corresponding to the coupled state; and the second SMA actuation spring is to increase tension in the second SMA actuation spring when electrically activated to cause the rocker to pivot toward the locked position corresponding to the uncoupled state.

12. The vehicle tailgate as defined in claim 11 wherein:

the first SMA actuation spring is antagonistic to the second SMA actuation spring through the rocker; and the first SMA actuation spring and the second SMA actuation spring are to be activated separately and exclusively to alternatively cause i) the first SMA actuation spring in a first activated state to overcome the second SMA actuation spring in a second unactivated state thereby to pivot the rocker to the unlocked position corresponding to the coupled state; or ii) the second SMA actuation spring in a second activated state to overcome the first SMA actuation spring in a first unactivated state thereby to pivot the rocker to the locked position corresponding to the uncoupled state.

13. The vehicle tailgate as defined in claim 10, further comprising a handle rotatably attached to the housing, the handle to be grasped and pulled, wherein:

the handle is to rotate to a pulled position in response to a pulling force exerted on the handle;

the handle is to return to a released position in an absence of the pulling force on the handle;

a hook is defined by the actuating lever, the hook to extend from the axis of rotation to engage with the coupling member when the rocker is in the unlocked position corresponding to the coupled state; and the hook has a deflector ramp to deflect the coupling member and prevent the coupling member from preventing the actuating lever from returning to a rest position in the absence of the pulling force on the handle.

14. The vehicle tailgate as defined in claim 10, wherein a hook is defined by the actuating lever, the hook to extend from the axis of rotation to engage with the coupling member when the rocker is in the unlocked position corresponding to the coupled state.

15. The vehicle tailgate as defined in claim 10 wherein the rocker is bistable in the locked position and the unlocked position.

16. The vehicle tailgate as defined in claim 10 wherein:

a bow spring is connected to the rocker at an edge attachment point of the rocker;

the edge attachment point is located on an edge of the rocker where the edge intersects a line perpendicular to the rocker and through the rocker pivot;

the bow spring is anchored on the substrate; and the bow spring causes the rocker to be bistable in the locked position and the unlocked position.

* * * * *